US009903178B2

(12) United States Patent
Sewell

(10) Patent No.: US 9,903,178 B2
(45) Date of Patent: Feb. 27, 2018

(54) HYDRAULIC FRACTURING WITH STRONG, LIGHTWEIGHT, LOW PROFILE DIVERTERS

(71) Applicant: Frederic D. Sewell, Dallas, TX (US)

(72) Inventor: Frederic D. Sewell, Dallas, TX (US)

( * ) Notice: Subject to any disclaimer, the term of this patent is extended or adjusted under 35 U.S.C. 154(b) by 0 days.

(21) Appl. No.: 15/447,099

(22) Filed: Mar. 1, 2017

(65) Prior Publication Data

US 2017/0175484 A1 Jun. 22, 2017

Related U.S. Application Data

(63) Continuation of application No. 15/356,656, filed on Nov. 20, 2016, now abandoned.

(60) Provisional application No. 62/259,681, filed on Nov. 25, 2015.

(51) Int. Cl.

| | |
|---|---|
| ***E21B 33/13*** | (2006.01) |
| ***E21B 43/26*** | (2006.01) |
| ***E21B 43/14*** | (2006.01) |
| *E21B 43/267* | (2006.01) |
| *E21B 47/06* | (2012.01) |

(52) U.S. Cl.

CPC ..... *E21B 33/13* (2013.01); *E21B 43/14* (2013.01); *E21B 43/26* (2013.01); *E21B 43/267* (2013.01); *E21B 47/06* (2013.01)

(58) Field of Classification Search

CPC .. E21B 2033/005; E21B 33/126; E21B 33/13; E21B 33/138; E21B 43/26; E21B 43/267; E21B 43/14

See application file for complete search history.

(56) References Cited

U.S. PATENT DOCUMENTS

| | | | |
|---|---|---|---|
| 4,160,482 | A | 7/1979 | Erbstoesser et al. |
| 4,187,909 | A | 2/1980 | Erbstoesser |
| 4,195,690 | A | 4/1980 | Erbstoesser et al. |
| 4,421,167 | A | 12/1983 | Erbstoesser et al. |
| 4,938,286 | A | 7/1990 | Jennings |
| 5,253,709 | A | 10/1993 | Kendrick et al. |
| 6,367,548 | B1 | 4/2002 | Purvis et al. |
| 7,185,706 | B2 | 3/2007 | Freyer |
| 7,213,651 | B2 | 5/2007 | Brannon et al. |
| 7,690,426 | B2 | 4/2010 | Misselbrook |
| 7,735,556 | B2 | 6/2010 | Misselbrook et al. |
| 2006/0175059 | A1 | 8/2006 | Sinclair et al. |

(Continued)

OTHER PUBLICATIONS

Perf Sealers, "The History of Perforation Ball Sealers in the Oil and Gas Industry," http://www.perfsealers.com/history-ball-sealers, retrieved Jun. 10, 2016, 3 pages.

(Continued)

*Primary Examiner* — Blake E Michener
*Assistant Examiner* — Christopher J Sebesta
(74) *Attorney, Agent, or Firm* — Hubbard Johnston, PLLC

(57) ABSTRACT

Low profile diverters for, and the use of such diverters in, fracing operations to stimulate production of oil and gas are capable of seating against and temporarily sealing perforations, even when frac fluid is being pumped at high rates and pressures, or in horizontal or highly deviated well bores, where conventional ball sealers cannot be reliably used because of high flow rates and pressures.

23 Claims, 4 Drawing Sheets

(56) References Cited

U.S. PATENT DOCUMENTS

| | | | | |
|---|---|---|---|---|
| 2007/0169935 | A1* | 7/2007 | Akbar | E21B 33/138 166/284 |
| 2008/0041581 | A1 | 2/2008 | Richards | |
| 2009/0156433 | A1 | 6/2009 | Mebratu et al. | |
| 2011/0226479 | A1* | 9/2011 | Tippel | E21B 33/138 166/305.1 |
| 2013/0068461 | A1 | 3/2013 | Maerz et al. | |
| 2014/0158356 | A1* | 6/2014 | Andrzejak | E21B 43/263 166/297 |
| 2015/0060069 | A1* | 3/2015 | Potapenko | E21B 33/138 166/284 |
| 2016/0319628 | A1* | 11/2016 | Schultz | E21B 33/138 |

OTHER PUBLICATIONS

Weatherford, "TBlockSure—Diverting Agent and Stimulation Enhancer", 2015, 8 pages.

* cited by examiner

HYDRAULIC FRACTURING WITH STRONG, LIGHTWEIGHT, LOW PROFILE DIVERTERS

RELATED APPLICATIONS

This application is a continuation of U.S. application Ser. No. 15/356,656 filed Nov. 20, 2016, which claims benefit of provisional application no. 62/259,681, filed Nov. 25, 2015, both of which are incorporated herein by reference for all purposes.

FIELD OF INVENTION

The invention pertains to hydraulic fracturing of subterranean geological formations to stimulate production of oil or natural gas from the formations.

BACKGROUND

Generally, more porous rock has more space for holding oil and gas. However sometimes relatively porous rock has low permeability. Permeability is a measure of the ease with which fluids will flow through rock. Shale is an example of rock with relatively high porosity but very low permeability due to the small grain size, which reduces the paths through which hydrocarbons can flow. Porosity of a rock is a measure of its capacity to contain or store fluids and can be calculated as the pore volume of the rock divided by its bulk volume. Rock's primary porosity is determined at the time of its deposition, but secondary porosity develops after deposition of the rock and includes spaces created by leaching or natural fracturing.

One way to stimulate or improve production from low permeability rock formations containing oil or gas is to create or enlarge fractures within the formations by a process called hydraulic fracturing ("facing"). Fracing involves pumping hydraulic fluid ("frac fluid") at high pressures and rates into a well bore, and then into the formation through perforations formed in the well casing. Perforating a well casing to create openings through which hydrocarbons can flow into the well may induce some fracturing within in the formation immediately adjacent the perforation. Fracing extends fractures already present in the formation, and causes new fractures, resulting in a network of fractures that substantially increases the permeability of the formation near the well bore.

In a "sand" frac a propping agent mixed with and carried by the frac fluid into fractures created and/or enlarged in the formation by the high pressure frac fluid. The sand fills the fractures and holds the rock formation faces apart after pumping of the frac fluid finishes, thereby propping open the fractures through which oil and gas flow more freely into the well bore. An "acid" frac typically does not require use of a propping agent, as the acid creates the fractures in the formation and etches or dissolves the fracture faces unevenly, thereby forming dissimilar fracture faces that can only partially close leaving fractures through which oil or gas can flow more freely.

Common examples of proppants include silica sand, resin-coated sand, and ceramic beads (and possibly mixtures of them.) Because silica sand is the predominant proppant used for fracing, "sand" has become petroleum industry jargon for any type of proppant or combination of proppants used in fracing. Therefore, the term "sand" in the specification and claims refers to any type of propping agent, or combinations of them, suitable for holding open fractures formed within a formation by a fracing operation unless otherwise plainly stated. The term "frac fluid" will be used to refer to any type of hydraulic fluid used for fracing that may be used to form fractures and/or enlarge natural fractures in the formation. Frac fluids may be water-based, oil-based, acid or acid-based, and or foam fluids. Additives can be used to control desired characteristics, such as viscosity. Furthermore, references to "frac fluid and sand" in the context of fracing are intended to also include frac fluid and acid unless the context states or plainly indicates otherwise.

Because of differences in permeability of the rock at each of the perforations due to different porosities or existing fractures (both naturally occurring and caused by perforating the casing), the rate at which frac fluid flows through perforations distributed a long a well bore may, and almost always does, vary along the length of the well bore. When stimulating vertical wellbores over 60 years ago the petroleum industry frequently used a high number of perforations (up to 4 perforations per foot of casing) throughout most of the oil and gas pay zones of a well bore. Such a large number of perforations resulted in the frac fluid and sand flowing first into more permeable rock. This resulted in fractures in the more permeable rock formations being packed with too much of the sand (or acid), which was intended to be distributed reasonably equal through the perforations. The less permeable formations were, consequently, not being sufficiently fractured. Solid, hard rubber balls, referred to as "ball sealers," were used to stimulate selectively the formation in vertical wellbores with an excessive number of perforations. After pumping a portion of the frac fluid with sand or acid, multiple ball sealers were pumped into the well and carried by the frac fluid to the perforation being stimulated. The balls temporarily sealed some of the perforations—those adjacent to fractures formed in the more permeable rock—and diverted the frac fluid, with the sand or acid, away from the stimulated perforations to other perforations in the next most permeable zone of rock that had not yet been stimulated. After pumping of frac fluid ceases, the ball sealers, no longer being held against the perforations by the differential pressure between the frac fluid within the well bore and the formation, fall off of the perforations to allow hydrocarbons from the fractured formation to flow into the well. However, the need for the relatively large and heavy ball sealers in vertical wellbores was minimized when industry began to selectively perforate only the better permeable zones (commonly referred to as "limited entry").

For horizontal or highly deviated directional oil and gas wells, the conventional petroleum industry practice today is to frac lateral well bores in stages. The length of a lateral portion of a well may be 4,000 feet to 7,500 feet, or substantially more, with cement typically sealing the void space between the casing and the hole. As with vertical wells, perforations in the well casing are formed to inject the frac fluid and sand or acid into the formation to cause it to fracture. Often 15 to 30, and sometimes more, stages are employed to frac a lateral well bore extending 4,000 to 7,500 feet or more. Each frac stage may have 4 to 8 clusters of perforations, with each cluster typically having 6 perforations.

The purpose of fracing in multiple stages is to distribute a generally equal amount of frac fluid and sand to all perforations in a manner that achieves optimal stimulation of each perforation along the entire length of the lateral portion of the well bore, thereby creating extensive cracking/fracturing of the rock formation surrounding the casing along its entire length. Each frac stage is isolated from the other stages and perforated and fraced separately. The petroleum industry experience of fracing a huge number of horizontal wells drilled to date appears to indicate that a large number of stages are required to ensure that a reasonably equal and sufficient volume of frac fluid and sand are pumped into each perforation. In the past few years, developments in hydraulic fracture technology indicate that superior stimulation results are achieved by using larger volumes of frac fluid and sand (15 million gallons and 15 million pounds of sand and more) pumped at extremely high rates (80 to 100 barrels per minute) and pressures (8,000-9,000 psi and more). The velocity of the frac fluid through the wellbore may reach or exceed 90 feet per second. Therefore, the industry continues to use the high-cost, multiple frac stages in an effort to distribute generally equal amounts of frac fluid and sand to all perforations in the lateral casing.

The commercial value of drilling horizontal wells with longer laterals and multiple stages fraced with larger volumes of frac fluid and sand pumped at high velocity and pressure has been established by achieving robust wells that have higher oil and gas producing rates and estimated ultimate recoveries of oil and gas. Effective frac stimulation of most or perhaps all of the perforations in a horizontal casing creates an extensive fracture system that opens and connects more reservoir rock to the wellbore. However, such frac jobs with a large number of stages are time consuming and expensive due to the repetitive plug, perforate and frac operation required to isolate and frac each individual stage. Completion costs typically represent about one-half of the total drilling and completion costs of a horizontal well. Although it is tempting to reduce costs by reducing the number of frac stages and increasing the number of perforations to be stimulated per stage, fewer stages with more perforations per stage risks partial or unequal stimulation of the perforations within the stages. Wells with ineffective stimulation have lower initial production rates and lower ultimate recovery of oil and gas.

SUMMARY

Fracing with low profile diverters, such as those described below, to selectively seal perforations temporarily during fracing to help to distribute frac fluid and sand uniformly in horizontal, deviated, or vertical wells reduces the need for a large number of frac stages. Such low profile diverters are capable of seating on and temporarily sealing perforations, even when frac fluid is being pumped at high rates and pressures. The diverters are large enough in two dimensions to cover and temporarily seal perforations in well casing, but relative thin in a third dimension orthogonal to the first two, and thus present a low profile, to reduce drag when seated on a perforation. The diverters are constructed to withstand the pressure of frac fluid pumped at high pressures against the diverter while it continues to temporarily seal a perforation. In comparison, conventional ball sealers are relatively larger and heavier, and have a large cross-sectional area. At high flow rates and pressures, frac fluid and sand may be flowing through a perforated liner at more than 90 feet per second, making it less likely that ball sealers will seat and remain seated to seal a perforation.

A process of fracing of a relatively long—4,000 to 7,500 feet, or more—wellbore using such diverters can be accomplished with a substantially reduced number of frac stages, and, in some cases, no stages.

In one embodiment of such a method, a predetermined amount of a frac fluid is pumped with sand or acid into a wellbore to cause fracturing of subterranean rock formation adjacent to a plurality of perforations formed in the casing of the wellbore. Prior to finishing pumping the predetermined amount of frac fluid with sand or acid into the well bore, diverters are introduced into the frac fluid entering the wellbore. The number is sufficient to seat against a portion, but not all, of the plurality of perforations to obstruct and temporarily seal them, thereby causing frac fluid to flow toward the remaining ones of the plurality of perforations not being obstructed while the frac fluid continues to be pumped under pressure into the well bore. Each of the diverters has, when seated on one of the plurality of perforations, a first surface facing the perforation opening and a second surface facing generally in the direction of a center line of the well bore, the area of the first surface being greater than the area of the perforation opening. Each of the diverters, when seated, presents a cross-sectional area to the flow of frac fluid through the well bore during pumping that is substantially smaller than the first and the second surface areas. Using this method, diverters are carried by the frac fluid to the stimulated perforations at which point they will temporarily seal off the stimulated perforations forcing the frac fluid and sand to enter the non-stimulated perforations in the next most permeable zone.

DETAILED DESCRIPTION OF EXEMPLARY EMBODIMENTS

Figure 1:
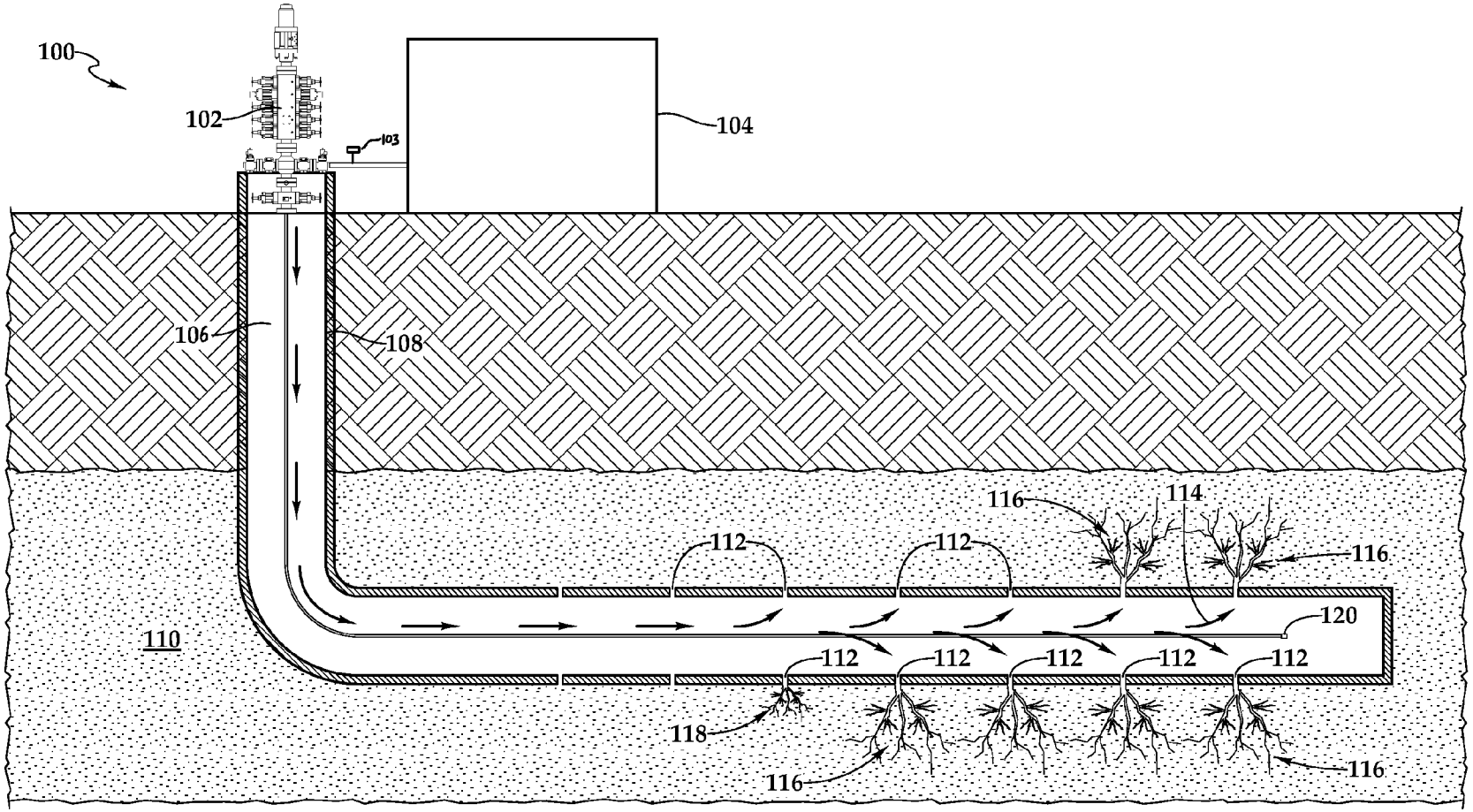
FIG. 1 is a simplified, schematic illustration of a well site with a well bore within a formation undergoing hydraulic fracturing.

The following description, in conjunction with the appended drawings describe one or more representative examples of embodiments in which the invention claimed below may be put into practice. Unless otherwise indicated, they are intended to be non-limiting examples for illustrating the principles and concepts of subject matter that is claimed. Like numbers refer to like elements in the drawings and the description.

FIG. 1 is a schematic illustration of a representative example of a wellbore undergoing fracing. It is not to scale. In this implementation the well site 100 has a well head 102 disposed at a top of a wellbore. The well head 102 is be coupled to a source of frac fluid 104. The source may be comprised of one or more tanks, reservoirs, or other storage structures for fluid and sand or acid. The well head 102 may include, or have coupled with it, various equipment and sensors, such as a surface pressure sensor 103. The surface pressure sensor 103 may be arranged to measure fluid pressure in the wellbore at the wellhead 102. Frac fluid stored in the fracing fluid storage 104 may be mixed with a sand or acid. Alternatively, sand or acid is introduced to the fluid at or upstream of the wellhead 102. In some implementations, for example when the target subterranean formation is a carbonate formation, the frac fluid may contain acid, in which case proppants may be unnecessary as the acid eats away the formation so that it cannot close. The well head 102 controls the injection of frac fluid into a wellbore 106. The wellbore may be horizontal, deviated, or vertical. In the example of FIG. 1, wellbore 106 extends horizontally into a target subterranean formation 110. The wellbore 106 is cased using a steel pipe 108 that is cemented in place. However, in some applications, the casing may not be cemented. Also, a casing liner may be used for the lateral section of the wellbore. The invention is not limited to any particular casing method.

Perforations 112 are formed through the well casing 108 to expose the surrounding subterranean formation 110 to the interior of wellbore 106, thereby allowing pressurized frac fluid with sand or acid to be injected through the perforations into the subterranean formation. The well casing may be perforated using any known method that produces perforations of a relatively consistent and predictable size. For example, perforations 112 may be formed by lowering shaped blasting charges into the well to a known depth, thereby creating clusters of perforations at desired points along the wellbore 106. In a typical application, perforations will, for example, be 0.4 to 0.5 inches in diameter, but in other applications they may have smaller or larger diameters.

During fracing operations, frac fluid will be pumped through the well head 102 and into the wellbore 106. The fluid will flow toward the perforations 112, as indicated by flow lines 114, and then out of the perforations 112 and into formation 110 to create new or enlarged fractures 116 within the formation. In this demonstrative, schematic illustration of FIG. 1, fractures 116 of the formation is indicated next to only some of the perforations, but not all. The fractures in this example are occurring in a portion or area of the formation into which more frac fluid is flowing due to, for example, higher permeability than the formation adjacent to the remaining perforations, which are indicated in the figure as having no new or enlarged fracturing, though in practice, new fractures or enlargement of existing fractures may in fact be taking place to a smaller degree.

In some implementations, a downhole pressure sensor (or pressure sensor array) 120 may be placed lowered into the horizontal portion of wellbore 106 near the perforations 112 to measure the pressure of the frac fluid close to perforations 112.

Although, in this example, the wellbore is not divided into multiple frac stages, the wellbore within the formation to be fraced can be divided into frac stages, with each stage separately isolated and fraced. The diverters and fracing method described below can be used with multiple stage fracing. However, the diverters allow for a reduction in the number of stages that is otherwise required to achieve similar results. They can also be used to frac without stages the entire wellbore within the zones of the formation expected to produce oil or gas.

Figure 2A:
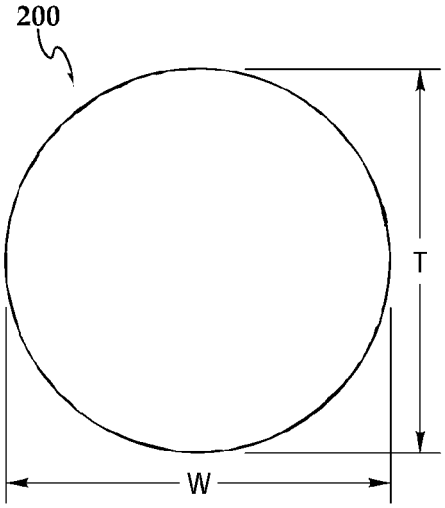
Fig.2A (PRIOR ART)
FIG. 2A is representation of a prior art ball sealer.

FIG. 2A illustrates, for purposes of comparison, a conventional, solid ball sealer 200 of the type found in the prior art. It has uniform diameter. Its width "W" is equal to its height "T," which is equal to its diameter. The diverters 202, 204, 206, 208 and 210 of FIGS. 2B-2F illustrate different cross-sectional shapes of a new type of diverter that is relatively thin and lightweight (as compared to ball sealers) and strong. The low profile diverters are sized to extend over and temporarily seal stimulated perforations, thereby diverting the flow of the fracing fluids and proppants to non-stimulated perforations. Each such low profile diverter has, in a preferred embodiment, an impermeable body with dimensions measured along each of two axes (the x and z axes in the coordinate frame illustrated in the figures) large enough to cover and temporarily seal a perforation in a well casing of a size that is typically made or that might be made for the particular application. In these examples each has the same width W, which is the diameter of ball sealer 200 (FIG. 2A). But, unlike a ball sealer, each has a dimension along an axis orthogonal to the other two axes (the y-axis) that is a substantially smaller than dimensions of the diverter along the first two axes, resulting in a relatively thin cross-section (or profile) that reduces drag caused by fluid flowing past the diverter while it seals a perforation. Due to the reduced drag such a diverter is more capable of seating onto perforations and sealing them off without being unseated by continued fluid flow over or past the diverters. The shape of the outer circumference of diverters in a plan view, which would be along the y-axis, or the cross-sectional shape of the diverters when sectioned normal to the y-axis, is circular in the examples given. However, other shapes could be used as long as the shortest dimension of the diverter in the x and z dimensions is large enough to cover and temporarily seal the expected perforations. Non-limiting examples of such shapes are oval, squarer, and polygonal shapes. Other shapes are possible.

When introduced into a flow of frac fluid into a wellbore during fracing, each diverter 202 to 210 is intended to temporarily seal one perforation after it has been stimulated with frac fluid and sand or acid. Though the specific cross-sectional areas for these diverters will vary based on different design and manufacturing considerations, the illustrated cross-sections of diverters 202 to 210 have much lower cross-sectional areas—preferably, 75 to 95 percent less—than the ball sealer 200 (or a comparable ball sealer capable of sealing similarly sized perforations.) They are, therefore, subject to substantially less drag force exerted by fast moving frac fluid than a traditional ball sealer. This large reduction in drag force allows the diverters to seat on and form a temporary seal of the stimulated perforations more easily and reliably. The relatively small cross-sectional area of such diverters thus minimizes the risk that the high velocity frac fluid flowing through the perforated liner could cause (1) failure of some diverters to seat on and seal stimulated perforations, or (2) diverters to be unseated from the stimulated perforations before completion of the frac job. The temporary seal is broken, and the diverters unseat, when the frac fluid pressure drops and the pressure differential across the diverter drops to the point that there is insufficient pressure to hold them against the perforations, thus allowing hydrocarbons to flow into the well from the formation.

Figure 2D:
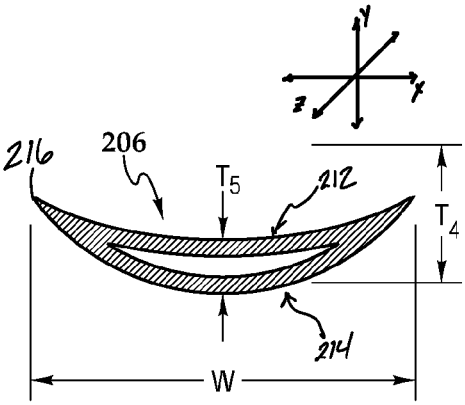
FIG. 2D is a representation of a third embodiment of a low profile diverter in cross-section.
Figure 2B:
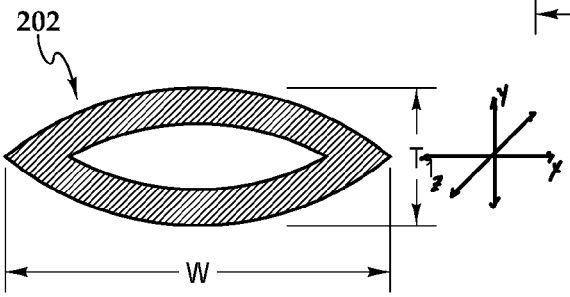
FIG. 2B is a representation of a first embodiment of a low profile diverter in cross-section.

Turning now to the specific examples of low profile diverters shown in FIGS. 2B-2F, the diverters are positioned to show their minimum cross-sectional width W along the x axis of the coordinate frame adjacent to each of the figures. As previously mentioned, each is shown with the same width as ball sealer 200 for purposes of comparison. Diverter 202 of FIG. 2B is shaped generally as a discus having an overall or greatest thickness T (measured along the y axis). The greatest thickness of the diverter 202 is in the center, and the thickness tapers towards side edges of the diverter. In comparison to the ball sealer 200, the discus shaped diverter 202 has the same minimum width W, but a considerably smaller thickness $T_1$. The cross-sectional area of diverter 202 is much less than the cross-sectional area of the ball sealer 200, and has a resistance to the flow of frac fluid estimated to be 25% of the resistance of the ball sealer 200. Accordingly, the discus shaped diverter 202 is capable of sealing a perforation, while having a much smaller cross-sectional area, and therefore a greatly decreased resistance to flowing frac fluid.

Figure 2E:
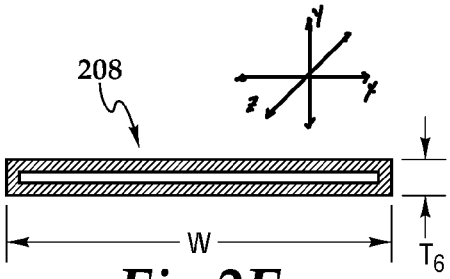
FIG. 2E is a representation of a fourth embodiment of a low profile diverter in cross-section.
Figure 2C:
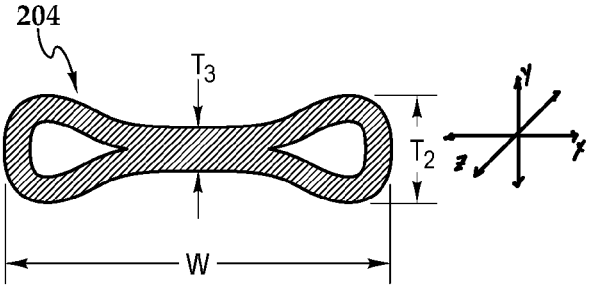
FIG. 2C is a representation of a second embodiment of a low profile diverter in cross-section.
Figure 2F:
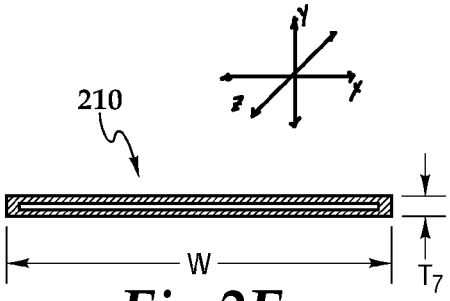
FIG. 2F is a representation of a fifth embodiment of a low profile diverter in cross-section.
Figure 3:
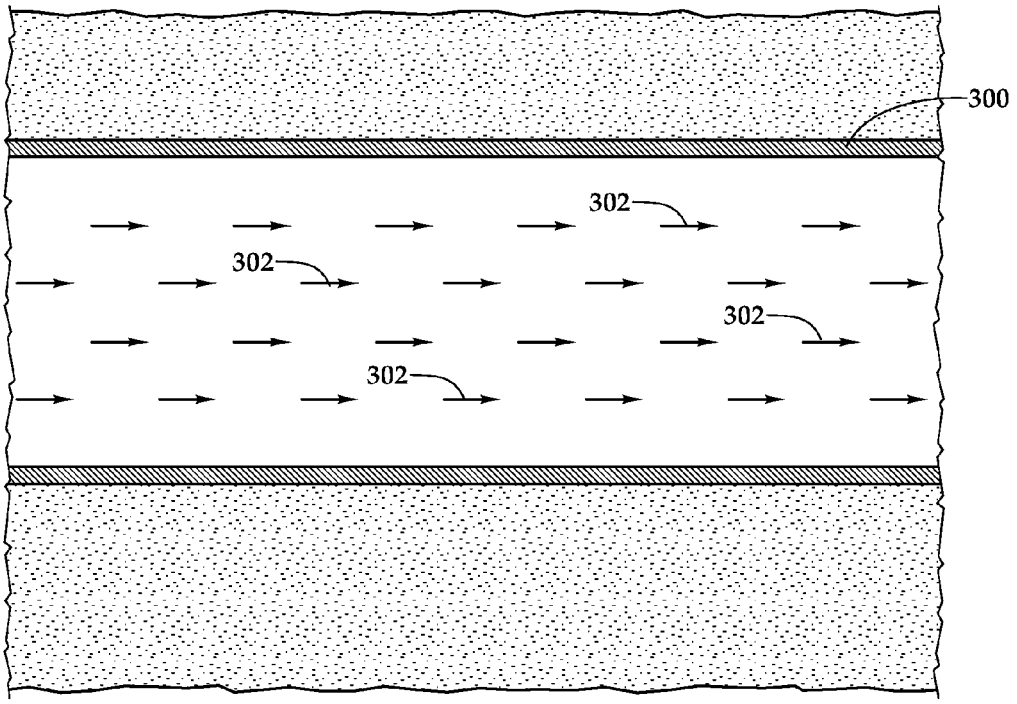
FIG. 3 represents a short section of a representative non-perforated cased horizontal wellbore upstream of the perforated representative wellbore shown in FIG. 4.

Diverter 204 of FIG. 2C is shaped as an erythrocyte, which has its greatest thickness $T_2$ along its outer perimeter or edge, but has center region with having a smaller thickness $T_3$. The resistance to frac fluid flow of the erythrocyte-shaped diverter 204 is estimated to be about 20% of the resistance of the ball sealer 200.

Diverter 206 of FIG. 2D is shaped like a saucer, having a convex bottom surface 214 with a first radius and a concave top surface 212 with a second radius different than the first radius. In this embodiment, the radius of the concave top surface 212 is greater than the radius of the convex side 214 so that the sides converge and intersect at outer edge 216 of the diverter. The diverter 206 has an overall thickness $T_4$ measured vertically from a lowest point of the convex bottom surface 214 to edge 216. Depending on the thickness $T_5$ (the actual thickness of which may depend on the materials and expected pressures), is estimated to have approximately 10% of the resistance of fluid as that of the ball sealer 200.

Diverter 208 of FIG. 2E is shaped as a disk, with a generally consistent thickness $T_6$ across its width W. In example shown, its resistance to the flow of frac fluid is estimated to be about 8% of that of the ball sealer 200. If the thickness is decreased to $T_7$, as shown by the example diverter 210 in FIG. 2F, it's estimated resistance to the flow of frac fluid drops to about 5% of that of the ball sealer 200.

The actual cross-sectional area of these diverters 202, 204, 206, 208, and 210 may vary from each other, even if intended to seal the same sized perforations. The exemplary diverters of FIG. 2B-2F have flat to curved surfaces to facilitate forming a temporary seal of the perforations. Furthermore, a diverter is constructed to be strong enough to seal the perforation without failing under the differential pressure across the diverter (the pressure acting against the surface of the diverter facing the inside of the casing less the pressure acting against the surface of the diverter facing the perforation) to which it is expected to be subject when seated on a perforation. The differential pressure will be the difference between the pressure of the frac fluid on the diverter inside the casing, acting against the diverter when sealing a perforation, which is a function of the pumping pressure on the frac fluid and the hydrostatic pressure of the frac fluid within the casing, and any fluid pressure outside the casing. In one embodiment, each of the diverters 202 to 210 is capable of withstanding at least 5000 psi of differential pressure without failing. In another embodiment, each diverter can withstand a differential pressure of at least 7500 psi without failing. In yet another embodiment, each diverter can withstand a differential pressure of at least 10,000 psi without failing. Furthermore, a diverter may, optionally, have a flexible and durable surface or coating to enhance sealing of the perforations. The diverters 202 to 210 may be partly or entirely constructed out of material or materials that allows them to be flexible, further enhancing their ability to form a seal over perforations 112. In some embodiments, diverters 202 to 210 may be constructed out of a composite material, which can be stronger and lighter than steel.

The shapes of diverters 202 to 210, particularly diverters 202, 204 and 206, allow them to be hollow to increase their displacement without increasing their weight. Therefore, the diverters may have a weight that is heavier, lighter or equal to the weight of its displacement of frac fluid. The embodiments of diverters 202, 204 and 206 are shown in figures as being hollow. However, in alternative embodiments, these diverters could be made solid. The disk and wafer shaped diverters will be strong and lightweight without necessarily being hollow.

Referring briefly back to FIG. 1, frac fluid is shown being pumped downhole from the well head 102 and into the wellbore 106, as indicated by the arrows with the wellbore. At this point, pumping has continued long enough to begin to fracture parts of the formation 110. The frac fluid is shown flowing into perforations 112 associated with relatively larger fractures 116, indicating that those parts of the formation have been stimulated. The large fractures are in zones or areas of the formation with relatively high permeability. The less developed fracture 118 is intended to illustrate an area of less permeability that has not yet completed fracturing. The other perforations have little to no fracturing of the formation next to them. Those areas of the formation have lower permeability and are not receiving enough frac fluid to start to fracture because it is flowing mostly into the parts of the formation with higher permeability.

Once some of the most permeable areas of the formation are approaching full stimulation, a predetermined number of thin or low profile diverters such as of FIGS. 2B-2F, are introduced at or near the well head into the flow of frac fluid entering the well bore, without stopping pumping of frac fluid and sand. These diverters are intended to temporarily seal only those perforations next to areas within the formation that have been fully stimulated—those, for example, next to fractures 116—and thus divert frac fluid and sand to less fractured or yet-to-be fractured areas of the formation.

Figure 4:
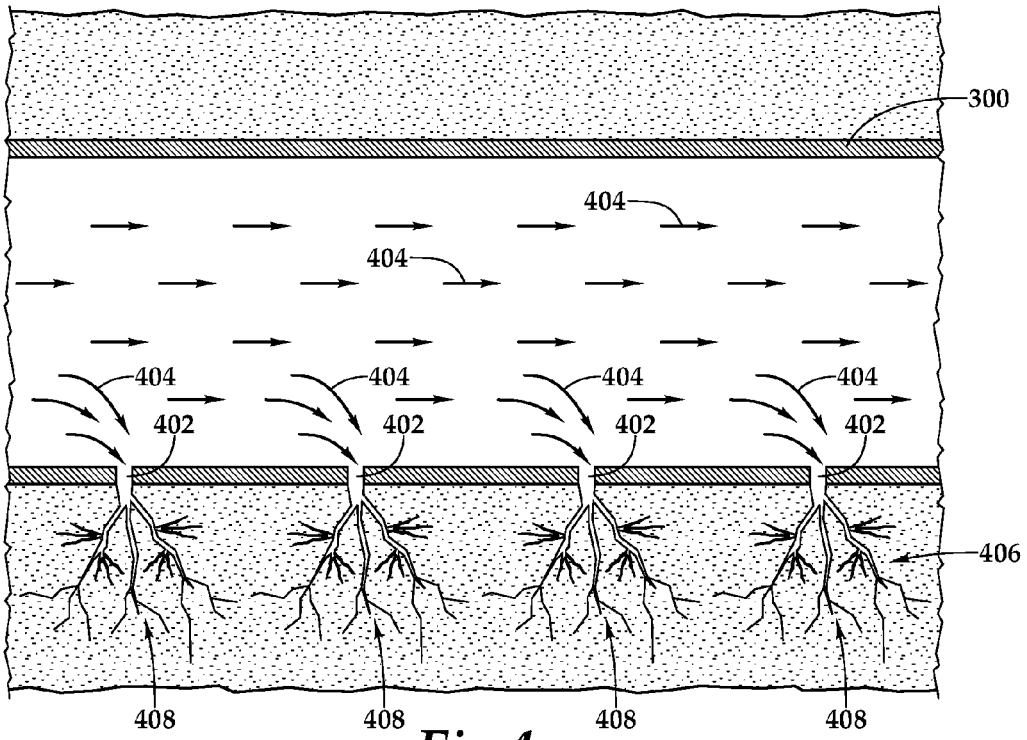
FIG. 4 illustrates the small section of a representative wellbore downstream of the representative wellbore shown in FIG. 3, with perforations formed therein and frac fluid flowing through the wellbore and perforations into the adjacent formation to cause fracturing.

Referring now to FIGS. 3 to 6, FIG. 3 illustrates a small section 300 of a horizontal wellbore casing upstream of the section 300 of casing with perforations (see FIG. 4), with flow arrows 302 indicating the direction of fluid flow downhole. The flow arrows 302 indicate how fluid flows in unperforated casing before reaching the perforated casing 300 shown in FIG. 4. FIG. 4 shows multiple perforations 402, after frac fluid has begun to be pumped under high pressures and at high flow rates downhole and through the wellbore. The flow of frac fluid is indicated by flow lines 404. All of the perforations are not sealed and therefore open. The pressurized frac fluid flows into the perforations adjacent to the areas or zones of the subterranean formation 406 where it is most permeable, as shown by directional lines 404. In the figure the perforations are adjacent to rock having, essentially, the same amount of permeability. Thus, in this example, it is shown flowing into all of the perforations. Although not shown, frac fluid, and thus also sand or acid, is not flowing, or flowing at lower rates, into perforations elsewhere within the segment of the wellbore that is being fraced (a segment corresponds to one frac stage or length of well bore undergoing a fracing operation) that are adjacent to less permeable parts of the formation. Thus, fractures 406 are being fractured first. Once the formation adjacent to perforations 402 are fully stimulated, meaning the frac fluid has fractured the subterranean formation 406 and the fractures 408 are packed with sand to hold them open, a predetermined number of low profile diverters, such as those shown in FIGS. 2B-2F, are pumped into the flowing frac fluid stream to seat and temporarily seal perforations 402 and thereby the frac fluid is redirected or diverted to the perforations within the wellbore adjacent to less permeable areas of formation to create fractures 118.

Figure 5:
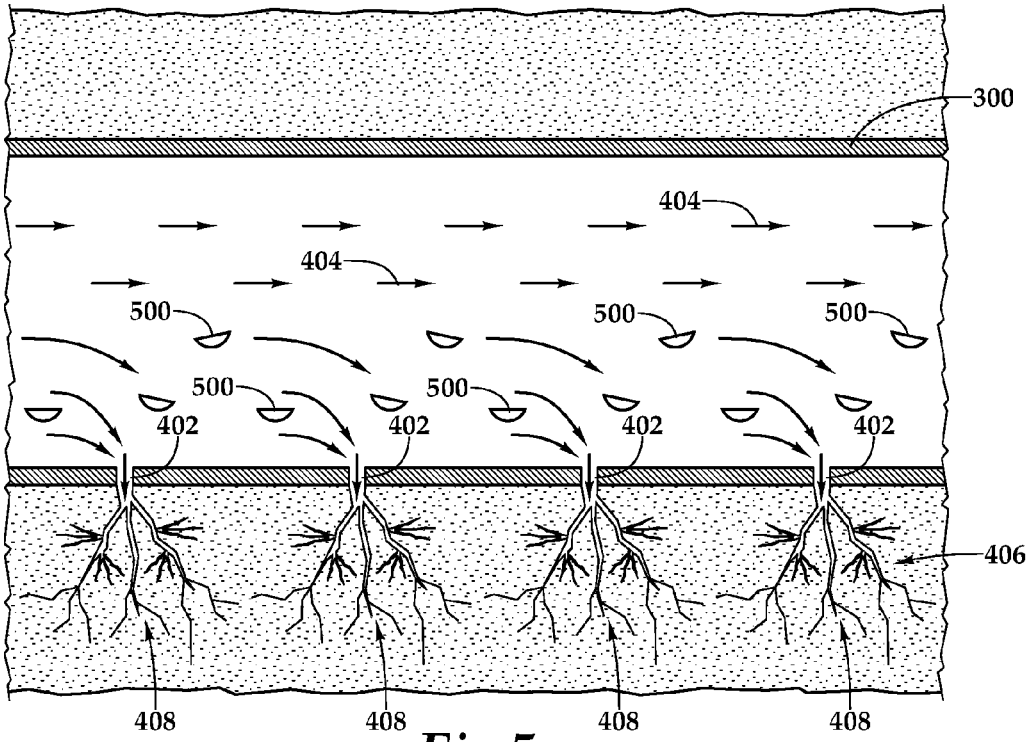
FIG. 5 illustrates the small section of a representative wellbore of FIG. 4, with the introduction of low profile diverters into the flow of frac fluid within the wellbore, before they seal perforations temporarily.
Figure 6:
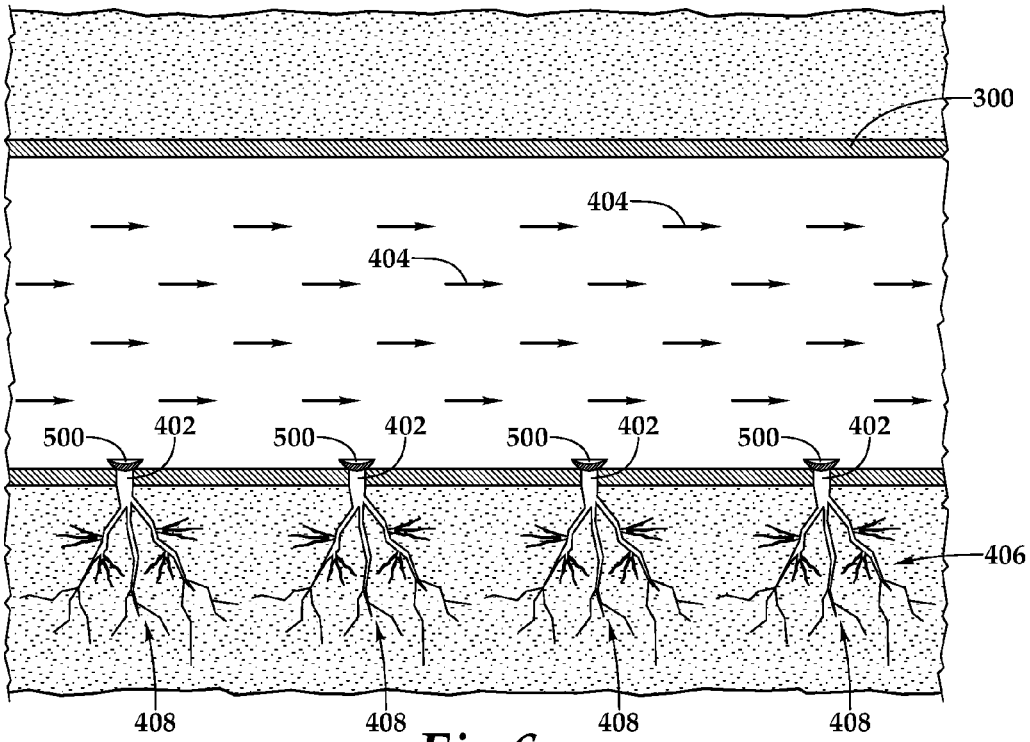
FIG. 6 illustrates the small section of a representative wellbore of FIG. 5, with the diverters previously introduced into the flow of frac fluid sealing perforations adjacent to stimulated formations.

In FIG. 5 the low profile diverters 500, which in this example are saucer shaped but can be any of any low profile shape capable of sealing against the perforations, are shown entrained in the flow of frac fluid and being moved toward perforations 402 by the flow of the frac fluid and sand into the perforations. In FIG. 6, the low profile diverters are shown seated on the openings of the perforations, engaging the edges of the perforations and thus temporarily sealing the perforations against substantial frac fluid flow. (A small amount of leakage may occur even when sealed.) The high pressure of the frac fluid within the well bore pushes against the seated diverters with sufficient force to keep them in place while the frac fluid flows past them, as indicated by the frac fluid flow lines 404 in the figure. Because of the low profile of the diverters, the frac fluid moving at a high rate within the wellbore is less likely to dislodge the low profile diverters as compared to conventional ball sealers.

Each diverter should temporarily seal one perforation, and only a perforation that has likely been stimulated with frac fluid and sand or acid, assuming that the diverter is introduced into the frac fluid flow at the right time. The number of diverters that are introduced into the flow of frac fluid is less than the number of perforations being stimulated. The pumping of the frac fluid continues and, after a period of time, an additional selected number of additional diverters can be introduced into the flowing frac fluid stream to temporarily seal some, but not all, of the remaining perforations. This process of continuing to pump frac fluid for some period of time before introducing a selected number of additional diverters is repeated as many times as necessary to selectively frac progressively less permeable parts of the formation until all of the volume of frac fluid with sand and the number of diverters designed and purchased for the job have been essentially depleted by pumping indicating that the stimulation of all perforations have been reasonably completely.

Use of low profile diverters as described above allows for the number of frac stages to be reduced, and possibly eliminate of the need for frac stages, even for wells with relatively long wellbores, even for long laterals that require fracturing at very high rates and pressures, as compared to current methods that do not make use of low profile diverters.

The following is an example. In this example, a 7,500 foot horizontal lateral well may have 30 stages of fracture stimulation with each stage being individually perforated with 36 perforations (total of 1,080 perforations for 30 stages), and then fraced with a "batch" of frac fluid and sand to stimulate the 36 perforations. Continuing with this example, rather than individually perforating and fracing each of the 30 stages, the method described herein could achieve relatively even distribution of frac fluid and sand along the later well using, in this example, 4 stages of frac stimulation, with 270 perforations per stage. (perforating approximately ¼ of the lateral casing length beginning at or near the end of the casing). Therefore, continuing with this example, the number of frac stages required would be reduced from 30 to 4 stages. Stage 1 begins with perforating the lateral casing with 270 perforations followed by continual pumping of frac fluid and sand for the duration of Stage 1. After pumping the predetermined volume of frac fluid and sand, 10 to 20 (or more or fewer) diverters are injected into the flow of frac fluid and sand to be carried in the fluid stream to seat and temporarily seal those perforations in the most permeable zones in the formation 110 that have been stimulated with frac fluid and sand. Once the diverters seat on and temporarily seal the stimulated perforations, the flowing frac fluid with sand is redirected or diverted to non-stimulated perforations in the wellbore adjacent to the next most permeable zones in the formation to create new fractures and expand natural fractures in the rock which are packed with sand to prevent closure of the fractures. Such Stage 1 procedure is repeated with the selective stimulation of perforations in the progressively next most permeable zones and seating on and temporarily sealing these perforations with diverters until all 270 Stage 1 perforations have been fully stimulated. At this time, a drillable ball or plug is pumped into the frac fluid stream to terminate the Stage 1 frac job. The first stage is thereby sealed it off from the subsequent Stage 2 frac job. Such balls are commonly used in multistage frac jobs for horizontal wells with long laterals. The first ball pumped at the end of Stage 1 has the smallest outside diameter with subsequent balls to end frac Stages 2 and 3 (no ball is needed to end frac Stage 4) having progressively larger outside diameters. The balls are sized to seat and seal in the receptacle in a special collar located in the casing immediately upstream of the Stage 1 perforations. Note that the use of ball drops to isolate a stage that has been fracked in this manner is just one example of a method for isolating stages. Other methods to isolate a stage could be used. The method is not limited to any particular method. The final pumping of the Stage 1 frac job continues until the first ball seats and seals off the Stage 1 perforations. The low profile diverters and method of using them should provide a more effective and efficient method to achieve reasonably equal distribution of sand in all perforations and, thereby, substantially reduce the cost to complete a well, particularly horizontal and highly deviated wells.

In the event two or more stages are required to achieve effective stimulation with reasonably equal distribution of frac fluid and sand throughout the entire lateral length of the casing, each subsequent stage would be separated from the stimulated stages. One example of how this is currently done is with a conventional drillable ball or plug (known as the "plug and perforate" process). However, the processes described herein are not limited by the method use for separating or isolating stages. Such use of the diverters should enable several batches of frac fluid and sand to stimulate many more perforations per frac stage. Substantially reducing and possibly eliminating the multiple frac stages currently required to stimulate a horizontal well will result in major reduction in the direct cost of a horizontal well.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. A method of stimulating production of hydrocarbons from a well bore having a casing through which has been formed a plurality of perforations, the method comprising:

pumping into the well bore under pressure a hydraulic fracture fluid containing proppant or an acid;

after pumping a the predetermined amount of the hydraulic fracture fluid containing proppant or acid into the well bore, introducing into the flow of hydraulic fracture fluid entering the well bore, a predetermined number of diverters into for seating against a portion, but not all, of the plurality of perforations to obstruct and temporarily seal them, thereby diverting the hydraulic fracture fluid containing proppant or acid toward the remaining ones of the plurality of perforations not being obstructed; and continuing to pump the hydraulic fracture fluid containing proppant or acid under pressure into the well bore;

wherein a body of each of the diverters has, prior to introducing the diverters into the flow of the hydraulic fracture fluid, a first surface and an opposing, second surface, the first surface having a maximum width and a maximum length and a first surface area, the second surface having a maximum width and a maximum length and a second surface area, and each of the diverters has a maximum thickness that is substantially smaller than the maximum width and length of the first surface and the second, and wherein when each of the diverters is seated on one of the plurality of perforations, the first surface faces a perforation opening and the second surface faces generally in the direction of a center line of the well bore the first surface area being greater than the perforation opening.

2. The method of claim 1, the pumping of hydraulic fluid containing proppant or acid continues without interruption when introducing the diverters into the flow of hydraulic fracture fluid.

3. The method of claim 1, wherein, when one of the plurality of diverters is seated on one of the plurality of perforations, it is held in place by pressure of the hydraulic fracture fluid within the well bore acting against the second surface of the diverter.

4. The method of claim 1, wherein the permeability of the subterranean formation adjacent to each of the plurality of stimulated perforations that are being at least partially obstructed and temporarily sealed by the predetermined number of diverters is greater than the permeability of the subterranean formation adjacent to each of the remaining ones of the plurality of perforations that are not being obstructed by a diverter.

5. The method of claim 1, wherein the body of each of the plurality of diverters has a shape chosen from a group of shapes comprising: a discus, erythrocyte, saucer, disk, and wafer.

6. The method of claim 1, wherein each of the number of diverters is hollow.

7. The method of claim 1, wherein each of the plurality of diverters is capable of staying seated while withstanding a differential pressure of 5,000 pounds per square inch.

8. The method of claim 1, wherein each of the plurality of diverters is capable of staying seated while withstanding a differential pressure of 7500 pounds per square inch.

9. The method of claim 1, each of the plurality of is capable of staying seated while withstanding a differential pressure of 10,000 pounds per square inch.

10. A method of stimulating production of hydrocarbons from a well bore having a casing, the method comprising:

establishing within the well bore a plurality of frac stages isolatable from each other; and for each of the plurality of frac stages, forming a plurality of perforations in the casing along a first section of the well bore;

pumping into the wellbore under pressure a predetermined amount of a hydraulic fracture fluid containing proppant or acid; and after a predetermined amount of hydraulic fracture fluid containing proppant or acid has been pumped into the well bore, introducing into the flow of hydraulic fracture fluid containing proppant or acid entering the well bore, without stopping pumping, a batch of diverters, the batch of diverters containing fewer diverters than the number of perforations in the plurality of perforations for seating against a portion, but not all, of the plurality of perforations to temporarily obstruct and seal them at least partially, thereby diverting the hydraulic fracture fluid containing proppant or acid toward the remaining ones of the plurality of perforations not being obstructed for fracturing the subterranean formation adjacent to them; and continuing to pump the hydraulic fracture fluid containing proppant or acid under pressure into the well bore;

wherein a body of each of the plurality of diverters has, when seated on one of the plurality of perforations, a first surface facing the perforation opening and a second surface facing generally in the direction of a center line of the well bore, an area of the first surface being greater than an area of the perforation opening, and wherein the body of each of the diverters, prior to introducing into the flow of hydraulic fracture fluid, has a first maximum dimension along a first axis that is smaller than a second maximum dimension and a third maximum dimension taken along second and third axes that are mutually orthogonal to the first axis, and wherein the first axis of the body of each of the diverters is normal to the center line.

11. The method of claim 10, wherein the body of each of the plurality of diverters has a shape chosen from a group of shapes comprising: a discus, erythrocyte, saucer, disk, and wafer.

12. The method of claim 10, wherein each of the plurality of diverters is hollow.

13. The method of claim 10, wherein each of the plurality of diverters is capable of withstanding a differential pressure of 5,000 pounds per square inch.

14. The method of claim 10, wherein the permeability of the subterranean formation adjacent to those of the plurality of perforations being obstructed and temporarily sealed by the diverters is greater than the permeability of the remaining ones of the plurality of perforations not being obstructed and temporarily sealed by the diverters.

15. A diverter for obstructing and temporarily sealing at least a portion of a perforation of a predetermined size or smaller in a casing of a well bore in a subterranean formation during hydraulic fracturing, the diverter, prior to insertion into the well bore, comprising:

an impermeable body being relatively rigid, the impermeable body having a cross-sectional maximum thickness that is substantially smaller than its maximum width or maximum length, the thickness being measured along a first axis, the length along a second axis and the width along a third axis, the first, second and third axes being mutually orthogonal; and wherein the maximum width and length are sufficient for the diverter to obstruct and temporarily seal the perforation.

16. The diverter of claim 15, wherein the impermeable body is shaped as a discus, a saucer, a disk, a wafer, or an erythrocyte.

17. The diverter of claim 15, wherein the diverter is capable of withstanding a differential pressure of 5,000 pounds per square inch.

18. The diverter of claim 15, wherein the second surface of the body is curved.

19. A non-spherical diverter for obstructing and temporarily sealing a perforation in a well casing in a subterranean formation during hydraulic fracturing, the diverter being non-spherical prior to insertion into the well casing, the diverter comprising an impermeable body having a first surface and an opposing, second surface, the first surface having a maximum width and a maximum length and a first surface area, the second surface having a maximum width and a maximum length and a second surface area, and the non-spherical body having a maximum thickness that is substantially smaller than the maximum width and length of the first surface and the second surface, wherein, when seated on a perforation, the first surface generally faces the perforation opening and the second surface faces generally in the opposite direction, toward a center line of the well, the second surface area being greater than the area of the perforation opening, and wherein the body, when seated on the perforation, has a cross-sectional area relative to a flow of hydraulic fracture fluid flowing through the well, the cross-sectional area being substantially smaller than the first and the second surface areas.

20. The diverter of claim 19, wherein the impermeable body has a shape chosen from a group of shapes comprising: a discus, erythrocyte, saucer, disk, and wafer.

21. The diverter of claim 19, wherein the body of the diverter is relatively rigid and after the diverter has been seated against the perforation opening, the diverter is shaped to withstand a differential pressure of 5,000 psi.

22. The diverter of claim 19, wherein the body has coating on its surface that is flexible to enhance sealing of the perforations.

23. The diverter of claim 19, wherein the second surface of the body is flat.

* * * * *